US009214251B2

(12) United States Patent
Sekiya et al.

(10) Patent No.: US 9,214,251 B2
(45) Date of Patent: Dec. 15, 2015

(54) ALUMINUM ALLOY CONDUCTOR

(75) Inventors: Shigeki Sekiya, Tokyo (JP); Kuniteru Mihara, Tokyo (JP); Kyota Susai, Tokyo (JP)

(73) Assignees: FURUKAWA ELECTRIC CO., LTD., Tokyo (JP); FURUKAWA AUTOMOTIVE SYSTEMS INC., Shiga (JP)

( * ) Notice: Subject to any disclaimer, the term of this patent is extended or adjusted under 35 U.S.C. 154(b) by 172 days.

(21) Appl. No.: 13/594,419

(22) Filed: Aug. 24, 2012

(65) Prior Publication Data

US 2012/0321889 A1 Dec. 20, 2012

Related U.S. Application Data

(63) Continuation of application No. PCT/JP2011/054397, filed on Feb. 25, 2011.

(30) Foreign Application Priority Data

Feb. 26, 2010 (JP) ..... 2010-043487

(51) Int. Cl.

| | |
|---|---|
| ***H01B 1/02*** | (2006.01) |
| ***C22C 21/00*** | (2006.01) |
| ***C22F 1/00*** | (2006.01) |
| ***C22F 1/04*** | (2006.01) |

(52) U.S. Cl.

CPC ..... *H01B 1/023* (2013.01); *C22C 21/00* (2013.01); *C22F 1/00* (2013.01); *C22F 1/04* (2013.01); *Y10T 428/2927* (2015.01)

(58) Field of Classification Search

IPC ..... H01B 1/023; C22C 21/00

See application file for complete search history.

(56) References Cited

U.S. PATENT DOCUMENTS

| | | | |
|---|---|---|---|
| 3,663,216 | A | 5/1972 | Hunsicker |
| 3,670,401 | A | 6/1972 | Schoerner |

(Continued)

FOREIGN PATENT DOCUMENTS

| | | | |
|---|---|---|---|
| GB | 1057152 | A | 2/1967 |
| GB | 1524355 | A | 9/1978 |

(Continued)

OTHER PUBLICATIONS

Merchant et al., "Characterization of Intermetallics in Aluminum Alloy 3004", Materials Characterization, 1990, vol. 25, pp. 339-373.

(Continued)

*Primary Examiner* — Roy King
*Assistant Examiner* — Janelle Morillo
(74) *Attorney, Agent, or Firm* — Birch, Stewart, Kolasch & Birch, LLP

(57) ABSTRACT

An aluminum alloy conductor, containing: 0.01 to 0.4 mass % of Fe, 0.1 to 0.3 mass % of Mg, 0.04 to 0.3 mass % of Si, 0.1 to 0.5 mass % of Cu, and 0.001 to 0.01 mass % of Ti and V in total, with the balance being Al and inevitable impurities, wherein the conductor contains three kinds of intermetallic compounds A, B, and C, in which the intermetallic compounds A, B, and C have a particle size of 0.1 μm or more but 2 μm or less, 0.03 μm or more but less than 0.1 μm, and 0.001 μm or more but less than 0.03 μm, respectively, and area ratios a, b, and c of the intermetallic compounds A, B, and C, in an arbitrary region in the conductor, satisfy: 0.1%≤a≤2.5%, 0.1%≤b≤3%, and 1%≤c≤10%.

8 Claims, 1 Drawing Sheet

(56) References Cited

U.S. PATENT DOCUMENTS

| | | | | |
|---|---|---|---|---|
| 8,353,993 | B2 * | 1/2013 | Kusakari et al. | 148/440 |
| 2008/0196923 | A1 | 8/2008 | Susai et al. | |
| 2010/0071933 | A1 | 3/2010 | Otsuka et al. | |

FOREIGN PATENT DOCUMENTS

| | | | |
|---|---|---|---|
| JP | 48-23609 | A | 3/1973 |
| JP | 49-43162 | B | 11/1974 |
| JP | 55-45626 | B2 | 11/1980 |
| JP | 2001-254160 | A | 9/2001 |
| JP | 2005-174554 | A | 6/2005 |
| JP | 2006-19163 | A | 1/2006 |
| JP | 2006-253109 | A | 9/2006 |
| JP | 2008-112620 | A | 5/2008 |
| WO | WO 98/42884 | A1 | 10/1998 |
| WO | WO 2010018646 | A1 * | 2/2010 |
| WO | WO 2010/082671 | A1 | 7/2010 |

OTHER PUBLICATIONS

International Search Report, issued in PCT/JP2011/054397, dated May 17, 2011.

* cited by examiner

ALUMINUM ALLOY CONDUCTOR

CROSS-REFERENCE TO RELATED APPLICATIONS

This application is a Continuation of PCT International Application No. PCT/JP2011/054397 filed on Feb. 25, 2011, which claims priority under 35 U.S.C 119 (a) to Patent Application No. 2010-043487 filed in Japan on Feb. 26, 2010, all which are hereby expressly incorporated by reference into the present application.

TECHNICAL FIELD

The present invention relates to an aluminum alloy conductor that is used as a conductor of an electrical wiring.

BACKGROUND ART

Hitherto, a member in which a terminal (connector) made of copper or a copper alloy (for example, brass) is attached to electrical wires composed of conductors of copper or a copper alloy, which is called a wire harness, has been used as an electrical wiring for movable bodies, such as automobiles, trains, and aircrafts. In weight reduction of movable bodies in recent years, studies have been progressing on use of aluminum or an aluminum alloy that is lighter than copper or a copper alloy, as a conductor for an electrical wiring.

The specific gravity of aluminum is about one-third of that of copper, and the electrical conductivity of aluminum is about two-thirds of that of copper (when pure copper is considered as a criterion of 100% IACS, pure aluminum has about 66% IACS). Therefore, in order to pass a current through a conductor of pure aluminum, in which the intensity of the current is identical to that through a conductor of pure copper, it is necessary to adjust the cross-sectional area of the conductor of pure aluminum to about 1.5 times larger than that of the conductor of pure copper, but aluminum conductor is still more advantageous than copper conductor in that the former has an about half weight of the latter.

Herein, the term "% IACS" mentioned above represents an electrical conductivity when the resistivity $1.7241\times10^{-8}$ Ωm of International Annealed Copper Standard is defined as 100% IACS.

There are some problems in using the aluminum as a conductor of an electrical wiring for movable bodies.

First, in order to form such an aluminum alloy conductor into an electrical wiring material, the conductor is required to have such a workability that problems of wire breakage, strand displacement, and the like are not caused upon working, such as cold-drawing and twisting. When the workability of an aluminum conductor is poor, the producibility thereof cannot be enhanced, and wire breakage of the conductor in the use thereof as an electrical wiring material is concerned since the conductor poor in workability has forcedly been undergone wire-drawing and twisting, to result in a problem of lack of durability and reliability.

Second, there is a problem of improvement in resistance to bending fatigue. The reason why resistance to bending fatigue is required for an aluminum conductor that is used in an electrical wiring of a movable body is that a repeated bending stress is applied to a wire harness attached to a door or the like, due to opening and closing of the door. A metal material such as aluminum is broken by fatigue breakage at a certain number of times of repeating of applying a load when the load is applied to or removed repeatedly as in opening and closing of a door, even at a low load at which the material is not broken by one time of applying the load thereto. When the aluminum conductor is used in an opening and closing part, if the conductor is poor in resistance to bending fatigue, it is concerned that the conductor is broken in the use thereof, to result in a problem of lack of durability and reliability.

In general, it is considered that as a material is higher in mechanical strength, it is better in fatigue property. Thus, it is preferable to use an aluminum conductor high in mechanical strength. On the other hand, since a wire harness is required to be readily in wire-running (i.e. an operation of attaching of it to a vehicle body) in the installation thereof, an annealed material is generally used in many cases, by which 10% or more of tensile elongation at breakage can be ensured.

According to the above, for an aluminum conductor that is used in an electrical wiring of a movable body, a material is required, which is excellent in mechanical strength that is required in handling and attaching, and which is excellent in electrical conductivity that is required for passing much electricity, as well as which is excellent in workability and resistance to bending fatigue.

For applications for which such a demand is exist, ones of pure aluminum-systems represented by aluminum alloy wires for electrical power lines (JIS A1060 and JIS A1070) cannot sufficiently tolerate a repeated bending stress that is generated by opening and closing of a door or the like. Further, although an alloy in which various additive elements are added is excellent in mechanical strength, the alloy has problems that the electrical conductivity is lowered due to solid-solution phenomenon of the additive elements in aluminum, flexibility is lowered, and deterioration of workability is caused due to formation of excess intermetallic compounds in aluminum. Therefore, it is necessary to limit and select additive elements, to prevent lowering in electrical conductivity, lowering in flexibility and deterioration of workability, and to enhance mechanical strength and resistance to bending fatigue.

Typical aluminum conductors used in electrical wirings of movable bodies include those described in Patent Literatures 1 to 4. However, as mentioned below, the inventions described in the patent literatures each have a further problem to be solved.

Since the alloy described in Patent Literature 1 contains a relatively large amount of Fe as 1.10 to 1.50% and is free from Cu, the resultant intermetallic compounds cannot be suitably controlled, which results in deterioration in workability, and wire breakage in wire drawing and the like.

Since the invention described in Patent Literature 2 does not define any content of Si, it is necessary to further study the effects of the resultant intermetallic compounds (enhancement in mechanical strength, and improvement in resistance to bending fatigue, and heat resistance).

Since, in Patent Literature 3, the content of Si is large, the resultant intermetallic compounds cannot be suitably controlled, which results in deterioration of workability, and wire breakage in wire drawing and the like.

The alloy described in Patent Literature 4 contains 0.01 to 0.5% of antimony (Sb), and thus is a technique that is being substituted by an alternate product in view of environmental load.

CITATION LIST

Patent Literatures

Patent Literature 1: JP-A-2006-19163 ("JP-A" means unexamined published Japanese patent application)
Patent Literature 2: JP-A-2006-253109

Patent Literature 3: JP-A-2008-112620

Patent Literature 4: JP-B-55-45626 ("JP-B" means examined Japanese patent publication)

SUMMARY OF INVENTION

Technical Problem

The present invention is contemplated for providing an aluminum alloy conductor, which has sufficient electrical conductivity and tensile strength, and which is excellent in workability, flexibility, resistance to bending fatigue, and the like.

Solution to Problem

The inventors of the present invention, having studied keenly, found that an aluminum alloy conductor, which is favorable in workability and which has excellent resistance to bending fatigue, mechanical strength, flexibility, and electrical conductivity, can be produced, by controlling the particle sizes and area ratios of three kinds of intermetallic compounds in an aluminum alloy to which specific additive elements are added, by controlling production conditions, such as a cooling speed in casting, and those in an intermediate annealing and a finish annealing. The present invention is attained based on those findings.

That is, according to the present invention, there is provided the following means:

(1) An aluminum alloy conductor, containing: 0.01 to 0.4 mass % of Fe, 0.1 to 0.3 mass % of Mg, 0.04 to 0.3 mass % of Si, and 0.1 to 0.5 mass % of Cu, and further containing 0.001 to 0.01 mass % of Ti and V in total, with the balance being Al and inevitable impurities, wherein the conductor contains three kinds of intermetallic compounds A, B, and C, in which the intermetallic compound A has a particle size within the range of 0.1 μm or more but 2 μm or less, the intermetallic compound B has a particle size within the range of 0.03 μm or more but less than 0.1 μm, the intermetallic compound C has a particle size within the range of 0.001 μm or more but less than 0.03 μm, and an area ratio a of the intermetallic compound A, an area ratio b of the intermetallic compound B, and an area ratio c of the intermetallic compound C, in an arbitrary region in the conductor, satisfy the relationships of $0.1\% \le a \le 2.5\%$, $0.1\% \le b \le 3\%$, and $1\% \le c \le 10\%$, respectively.

(2) An aluminum alloy conductor, containing: 0.01 to 0.4 mass % of Fe, 0.1 to 0.3 mass % of Mg, 0.04 to 0.3 mass % of Si, 0.1 to 0.5 mass % of Cu, and 0.01 to 0.4 mass % of Zr, and further containing 0.001 to 0.01 mass % of Ti and V in total, with the balance being Al and inevitable impurities, wherein the conductor contains three kinds of intermetallic compounds A, B, and C, in which the intermetallic compound A has a particle size within the range of 0.1 μm or more but 2 μm or less, the intermetallic compound B has a particle size within the range of 0.03 μm or more but less than 0.1 μm, the intermetallic compound C has a particle size within the range of 0.001 μm or more but less than 0.03 μm, and an area ratio a of the intermetallic compound A, an area ratio b of the intermetallic compound B, and an area ratio c of the intermetallic compound C, in an arbitrary region in the conductor, satisfy the relationships of $0.1\% \le a \le 2.5\%$, $0.1\% \le b \le 5.5\%$, and $1\% \le c \le 10\%$, respectively.

(3) The aluminum alloy conductor according to (1) or (2), which has a grain size at a vertical cross-section in the wire-drawing direction of 1 to 30 μm, by subjecting to a continuous electric heat treatment, which comprises the steps of rapid heating and quenching at the end of the production process of the conductor.

(4) The aluminum alloy conductor according to any one of (1) to (3), which has a tensile strength of 100 MPa or more, and an electrical conductivity of 55% IACS or more.

(5) The aluminum alloy conductor according to any one of (1) to (4), which has a tensile elongation at breakage of 10% or more.

(6) The aluminum alloy conductor according to any one of (1) to (5), which has a recrystallized microstructure.

(7) The aluminum alloy conductor according to any one of (1) to (6), wherein the conductor is used as a wiring for a battery cable, a harness, or a motor, in a movable body.

(8) The aluminum alloy conductor according to any one of (1) to (7), wherein the conductor is used in a vehicle, a train, or an aircraft.

Advantageous Effects of Invention

The aluminum alloy conductor of the present invention is excellent in the workability in the production into a wire, the mechanical strength, the flexibility, and the electrical conductivity, and is useful as a conductor for a battery cable, a harness, or a motor, each of which is mounted on a movable body, and thus can also be preferably used for a door, a trunk, a hood (or a bonnet), and the like, for which an excellent resistance to bending fatigue is required.

Other and further features and advantages of the invention will appear more fully from the following description, appropriately referring to the accompanying drawings.

BRIEF DESCRIPTION OF THE DRAWINGS

FIG. 1 is an explanatory view of the test for measuring the number of times of repeated breakage, which was conducted in the Examples.

FIG. 2 is an explanatory view of the test for evaluating workability, which was conducted in the Examples.

MODE FOR CARRYING OUT THE INVENTION

Figure 1:
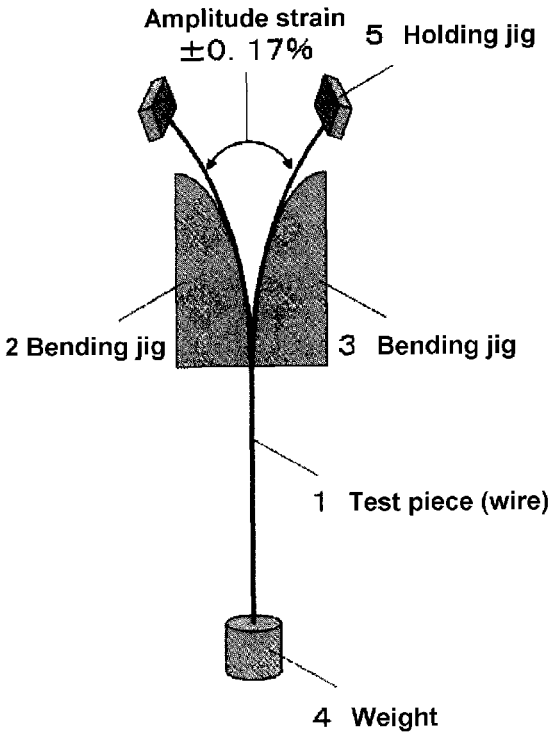
{FIG. 1}

A preferable first embodiment of the present invention is an aluminum alloy conductor, which contains 0.01 to 0.4 mass % of Fe, 0.1 to 0.3 mass % of Mg, 0.04 to 0.3 mass % of Si, and 0.1 to 0.5 mass % of Cu, and further contains 0.001 to 0.01 mass % of Ti and V in total, with the balance being Al and inevitable impurities, wherein the conductor contains three kinds of intermetallic compounds A, B, and C, in which the intermetallic compound A has a particle size within the range of 0.1 μm or more but 2 μm or less, the intermetallic compound B has a particle size within the range of 0.03 μm or more but less than 0.1 μm, the intermetallic compound C has a particle size within the range of 0.001 μm or more but less than 0.03 μm, and the area ratio a of the intermetallic compound A, the area ratio b of the intermetallic compound B, and the area ratio c of the intermetallic compound C, in an arbitrary region in the conductor, satisfy the relationships of $0.1\% \le a \le 2.5\%$, $0.1\% \le b \le 3\%$, and $1\% \le c \le 10\%$, respectively.

In this embodiment, the reason why the content of Fe is set to 0.01 to 0.4 mass % is to utilize various effects by mainly Al—Fe-based intermetallic compounds. Fe is made into a solid solution in aluminum in an amount of only 0.05 mass % at 655° C., and is made into a solid solution lesser at room temperature. The remainder of Fe is crystallized or precipitated as intermetallic compounds, such as Al—Fe, Al—Fe—Si, Al—Fe—Si—Mg, and Al—Fe—Cu—Si. The crystallized or precipitated product acts as a refiner for grains to make the grain size fine, and enhances the mechanical strength and resistance to bending fatigue. On the other hand, the mechanical strength is enhanced also by the solid-solution of Fe. When the content of Fe is too small, these effects are insufficient, and when the content is too large, it causes wire breakage in wire-drawing and twisting due to coarsening of the crystallized product. Also, the intended resistance to bending fatigue cannot be obtained, and the flexibility is also lowered. The content of Fe is preferably 0.15 to 0.3 mass %, more preferably 0.18 to 0.25 mass %.

In this embodiment, the reason why the content of Mg is set to 0.1 to 0.3 mass % is to make Mg into a solid solution in the aluminum matrix, and to strengthen the resultant alloy. Further, another reason is to make a part of Mg form a precipitate with Si, to make it possible to enhance mechanical strength, and to improve resistance to bending fatigue and heat resistance. When the content of Mg is too small, the above-mentioned effects are insufficient, and when the content is too large, electrical conductivity and flexibility are lowered. Furthermore, when the content of Mg is too large, the yield strength becomes excessive, the formability and twistability are deteriorated, and the workability becomes worse. The content of Mg is preferably 0.15 to 0.3 mass %, more preferably 0.2 to 0.28 mass %.

In this embodiment, the reason why the content of Si is set to 0.04 to 0.3 mass % is to make Si form a compound with Mg, to act to enhance the mechanical strength, and to improve resistance to bending fatigue and heat resistance, as mentioned above. When the content of Si is too small, the above-mentioned effects become insufficient, and when the content is too large, the electrical conductivity and flexibility are lowered, and the formability and twistability are deteriorated, and the workability becomes worse. Furthermore, the precipitation of a single body of Si in the course of the heat treatment in the production of a wire results in wire breakage. The content of Si is preferably 0.06 to 0.25 mass %, more preferably 0.10 to 0.25 mass %.

In this embodiment, the reason why the content of Cu is set to 0.1 to 0.5 mass % is to make Cu into a solid solution in the aluminum matrix, to strengthen the resultant alloy. Furthermore, Cu also contributes to the improvement in creep resistance, resistance to bending fatigue, and heat resistance. When the content of Cu is too small, the effect thereof cannot be sufficiently exerted, and when the content is too large, lowering in corrosion resistance, electrical conductivity, and flexibility is caused. Further, the workability becomes worse. The content of Cu is preferably 0.20 to 0.45 mass %, more preferably 0.25 to 0.40 mass %.

In this embodiment, Ti and V each act as a refiner for microstructure of an ingot in melt-casting. If the microstructure of the ingot is coarse, cracks occur in the course of wire-drawing, which is not desirable from industrial viewpoints. When the content of Ti and V in total is too small, the effects are insufficient, and when the total content is too large, electrical conductivity is conspicuously lowered and the effects are also saturated. The content of Ti and V in total is preferably 0.002 to 0.008 mass %, more preferably 0.003 to 0.006 mass %.

A preferable second embodiment of the present invention is an aluminum alloy conductor, which contains 0.01 to 0.4 mass % of Fe, 0.1 to 0.3 mass % of Mg, 0.04 to 0.3 mass % of Si, 0.1 to 0.5 mass % of Cu, and 0.01 to 0.4 mass % of Zr, and further contains 0.001 to 0.01 mass % of Ti and V in total, with the balance being Al and inevitable impurities. The conductor contains three kinds of intermetallic compounds A, B, and C, in which the intermetallic compound A has a particle size within the range of 0.1 μm or more but 2 μm or less, the intermetallic compound B has a particle size within the range of 0.03 μm or more but less than 0.1 μm, the intermetallic compound C has a particle size within the range of 0.001 μm or more but less than 0.03 μm, and the area ratio a of the intermetallic compound A, the area ratio b of the intermetallic compound B, and the area ratio c of the intermetallic compound C, in an arbitrary region in the conductor, satisfy the relationships of $0.1\% \leq a \leq 2.5\%$, $0.1\% \leq b \leq 5.5\%$, and $1\% \leq c \leq 10\%$, respectively.

In the second embodiment, the alloy composition is that 0.01 to 0.4 mass % of Zn is further contained, in addition to the alloy composition of the above-mentioned first embodiment. Zr forms an intermetallic compound with Al, and is made into a solid solution in Al, thereby to contribute to enhancement in mechanical strength and improvement in heat resistance of the aluminum alloy conductor. When the content of Zr is too small, the effect thereof cannot be expected, and when the content is too large, the melting temperature becomes high and thus formation of a drawn wire is difficult. Furthermore, the electrical conductivity, flexibility, workability, and resistance to bending fatigue are also deteriorated. The content of Zr is preferably 0.1 to 0.35 mass %, more preferably 0.15 to 0.3 mass %.

Other alloy composition and the effect thereof are similar to those in the above-mentioned first embodiment.

In the aluminum alloy conductor of the present invention, by defining the sizes (particle sizes) and area ratios of the intermetallic compounds, besides the above-mentioned alloying elements, an aluminum alloy conductor can be obtained, which has the desired excellent workability, resistance to bending fatigue, mechanical strength, and electrical conductivity.

(Sizes (Particle Sizes) and Area Ratios of Intermetallic Compounds)

As shown in the first and second embodiments, the present invention contains three kinds of intermetallic compounds different in particle size each other at the respective predetermined area ratios. Herein, the intermetallic compounds are particles of crystallized products, precipitated products, and the like, which are present inside the grains. Mainly, the crystallized products are formed upon melt-casting, and the precipitated products are formed in intermediate annealing and finish annealing, such as particles of Al—Fe, Al—Fe—Si, Al—Zr, and Al—Fe—Si—Cu. The area ratio refers to the ratio of the intermetallic compound contained in the present alloy as represented in terms of area, and can be calculated as mentioned in detail below, based on a picture observed by TEM.

The intermetallic compound A is mainly constituted by Al—Fe, Al—Fe—Si, Al—Fe—Si—Cu, Al—Zr, and the like. These intermetallic compounds act as refiners for grains, and enhance the mechanical strength and resistance to bending fatigue. The reason why the area ratio a of the intermetallic compound A is set to $0.1\% \leq a \leq 2.5\%$ is that, when the area ratio is too small, these effects are insufficient, and when the area ratio is too large, it becomes a cause of wire breakage in working into a wire due to coarsening of the crystallized product. Furthermore, the intended resistance to bending fatigue cannot be obtained, and the flexibility is also lowered.

The intermetallic compound B is mainly constituted by Al—Fe—Si, Al—Fe—Si—Cu, Al—Zr, and the like. These intermetallic compounds enhance the mechanical strength and improve resistance to bending fatigue, through precipitation. The reason why the area ratio b of the intermetallic compound B is set to $0.1\% \leq b \leq 3\%$ in the first embodiment and $0.1\% \leq b \leq 5.5\%$ in the second embodiment is that, when the area ratio is too small, these effects are insufficient, and when the area ratio is too large, it becomes a cause of wire breakage due to excess precipitation. Furthermore, the flexibility is also lowered.

The intermetallic compound C enhances the mechanical strength and significantly improves the resistance to bending fatigue. The reason why the area ratio c of the intermetallic compound C is set to $1\% \leq c \leq 10\%$ is that, when the area ratio is too small, these effects are insufficient, and when the area ratio is too large, it becomes a cause of wire breakage due to excess precipitation. Furthermore, the flexibility is also lowered.

In the first and second embodiments of the present invention, to adjust the area ratios of the intermetallic compounds A, B and C of three kinds of sizes to the above-mentioned values, it is necessary to set the respective alloy compositions to the above-mentioned ranges. Furthermore, the area ratios can be realized by suitably controlling the cooling speed in casting, the intermediate annealing temperature, the conditions in finish annealing, and the like.

The cooling speed in casting refers to an average cooling speed from the initiation of solidification of an aluminum alloy ingot to 200° C. As the method for changing this cooling speed, for example, the following three methods may be exemplified. Namely, (1) changing the size (wall thickness) of an iron casting mold, (2) forcedly-cooling by disposing a water-cooling mold on the bottom face of a casting mold (the cooling speed is changed also by changing the amount of water), and (3) changing the casting amount of a molten metal. When the cooling speed in casting is too slow, excess crystallization of Fe occurs, and thus the intended microstructure cannot be obtained, to deteriorate the workability. When the speed is too fast, excess solid-solution of Fe occurs, and thus the intended microstructure cannot be obtained, to lower the electrical conductivity. In some cases, casting cracks may occur. The cooling speed in casting is preferably 1 to 20° C./sec, more preferably 5 to 15° C./sec.

The intermediate annealing temperature refers to a temperature when a heat treatment is conducted in the mid way of wire drawing. The intermediate annealing is mainly conducted for recovering the flexibility of a wire that has been hardened by wire drawing. In the case where the intermediate annealing temperature is too low, recrystallization is insufficient and thus the yield strength is excessive and the flexibility cannot be ensured, which result in a high possibility that wire breakage may occur in the later wire drawing and a wire cannot be obtained. On the other hand when too high, the resultant wire is in an excessively annealed state, and the recrystallized grains become coarse and thus the flexibility is significantly lowered, which result in a high possibility that wire breakage may occur in the later wire drawing and a wire cannot be obtained. The intermediate annealing temperature is preferably 300 to 450° C., more preferably 300 to 400° C. The time period for intermediate annealing is generally 10 min or more. If the time period is less than 10 min, the time period required for the formation and growth of recrystallized grains is insufficient, and thus the flexibility of the wire cannot be recovered. The time period is preferably 1 to 4 hours. Furthermore, although the average cooling speed from the heat treatment temperature in the intermediate annealing to 100° C. is not particularly defined, it is desirably 0.1 to 10° C./min.

The finish annealing is conducted, for example, by a continuous electric heat treatment in which annealing is conducted by the Joule heat generated from the wire in interest itself that is running continuously through two electrode rings, by passing an electrical current through the wire. The continuous electric heat treatment has the steps of: rapid heating and quenching, and can conduct annealing of the wire, by controlling the temperature of the wire and the time period. The cooling is conducted, after the rapid heating, by continuously passing the wire through water. In one of or both of the case where the wire temperature in annealing is too low or too high and the case where the annealing time period is too short or too long, an intended microstructure cannot be obtained. Furthermore, in one of or both of the case where the wire temperature in annealing is too low and the case where the annealing time period is too short, the flexibility that is required for attaching the resultant wire to vehicle to mount thereon cannot be obtained; and in one of or both of the case where the wire temperature in annealing is too high and in the case where the annealing time period is too long, the mechanical strength is lowered and the resistance to bending fatigue also becomes worse. Namely, when a numerical formula represented by a wire temperature y (° C.) and an annealing time period x (sec) is utilized, it is preferable to utilize the annealing conditions that satisfy: $26x^{-0.6}+377 \leq y \leq 19x^{-0.6}+477$, within the range of: $0.03 \leq x \leq 0.55$. The wire temperature represents the highest temperature of the wire at immediately before passing through water.

Besides the continuous electric heat treatment, the finish annealing may be, for example, a continuous annealing in which annealing is conducted by continuously passing the wire in an annealing furnace kept at a high temperature, or an induction heating in which annealing is conducted by continuously passing the wire in a magnetic field, each of which has the steps of rapid heating and quenching. Although the annealing conditions are not identical with the conditions in the continuous electric heat treatment, since the atmospheres and heat-transfer coefficients are different from each other, even in the cases of these continuous annealing and induction heating each of which has the steps of rapid heating and quenching, the aluminum alloy conductor of the present invention can be prepared, by suitably controlling the finish-annealing conditions (thermal history) by referring to the annealing conditions in the continuous electric heat treatment as a typical example, so that the aluminum alloy conductor of the present invention having a prescribed precipitation state of the intermetallic compounds can be obtained.

(Grain Size)

The aluminum alloy conductor of the present invention has a grain size of 1 to 30 μm in a vertical cross-section in the wire-drawing direction. This is because, when the grain size is too small, a partial recrystallized microstructure remains and the tensile elongation at breakage is lowered conspicuously, and on the other hand, when too large, a coarse microstructure is formed and deformation behavior becomes uneven, and the tensile elongation at breakage is lowered similar to the above, and further the strength is lowered conspicuously. The grain size is more preferably 1 to 20 μm.

(Tensile Strength and Electrical Conductivity)

The aluminum alloy conductor of the present invention preferably has a tensile strength (TS) of 100 MPa or more and an electrical conductivity of 55% IACS or more, more preferably has a tensile strength of 100 to 160 MPa and an electrical conductivity of 55 to 65% IACS, further preferably has a tensile strength of 100 to 150 MPa and an electrical conductivity of 58 to 63% IACS.

The tensile strength and the electrical conductivity are conflicting properties, and the higher the tensile strength is, the lower the electrical conductivity is, whereas pure aluminum low in tensile strength is high in electrical conductivity. Therefore, in the case where an aluminum alloy conductor has a tensile strength of less than 100 MPa, the mechanical strength, including that in handling thereof, is insufficient, and thus the conductor is difficult to be used as an industrial conductor. It is preferable that the electrical conductivity is 55% IACS or more, since a high current of dozens of amperes (A) is to pass through it when the conductor is used as a power line.

(Flexibility)

The aluminum alloy conductor of the present invention has sufficient flexibility. This can be obtained by conducting the above-mentioned finish annealing. As mentioned above, a tensile elongation at breakage is used as an index of flexibility, and is preferably 10% or more. This is because if the tensile elongation at breakage is too small, wire-running (i.e. an operation of attaching of it to a vehicle body) in installation of an electrical wiring becomes difficult as mentioned above. Furthermore, it is desirable that the tensile elongation at breakage is 50% or less, since if too high, the mechanical strength becomes insufficient and the resultant conductor is weak in wire-running, which may results in wire breakage. The tensile elongation at breakage is more preferably 10% to 40%, further preferably 10 to 30%.

The aluminum alloy conductor of the present invention can be produced via steps of: [1] melting, [2] casting, [3] hot- or cold-working (e.g. caliber rolling with grooved rolls), [4] wire drawing, [5] heat treatment (intermediate annealing), [6] wire drawing, and [7] heat treatment (finish annealing).

[1] Melting

To obtain the aluminum alloy composition according to the present invention, Fe, Mg, Si, Cu, Ti, V, and Al, or Fe, Mg, Si, Cu, Ti, V, Zr, and Al, are melted at amounts that provide the desired contents.

[2] Casting and [3] Hot- or Cold-Working (e.g. Caliber Rolling with Grooved Rolls)

Then, for example, a molten metal is rolled while the molten metal is continuously cast in a water-cooled casting mold; by using a Properzi-type continuous cast-rolling machine which has a casting ring and a belt in combination, to give a rod of about 10 mm in diameter. The cooling speed in casting at this time is preferably 1 to 20° C./sec as mentioned above. The casting and hot rolling may be conducted by billet casting at a cooling speed in casting of 1 to 20° C./sec, extrusion, or the like.

[4] Wire Drawing

Then, peeling of the surface is conducted to adjust the diameter to 9 to 9.5 mm, and the thus-peeled rod is subjected to wire drawing. Herein, when the cross-sectional area of the wire (or rod) before the wire drawing is represented by $A_0$, and the cross-sectional area of the wire after the wire drawing is represented by $A_1$, a working degree represented by $\eta=\ln(A_0/A_1)$ is preferably from 1 to 6. If the working degree is less than 1, the recrystallized grains are coarsened and the mechanical strength and tensile elongation at breakage are conspicuously lowered in the heat treatment in the subsequent step, which may be a cause of wire breakage. If the working degree is more than 6, the wire drawing becomes difficult due to excess work-hardening, which is problematic in the quality in that, for example, wire breakage occurs upon the wire drawing. Although the surface of the wire (or rod) is cleaned up by conducting peeling of the surface thereof, the peeling may be omitted.

[5] Heat Treatment (Intermediate Annealing)

The thus-worked product that has undergone cold drawing (i.e. a roughly-drawn wire), is subjected to intermediate annealing. As mentioned above, the conditions for the intermediate annealing are preferably 300 to 450° C. and 10 minutes or more.

[6] Wire Drawing

The thus-annealed roughly-drawn wire is further subjected to wire drawing. Also at this time, the working degree is desirably from 1 to 6 for the above-mentioned reasons.

[7] Heat Treatment (Finish Annealing)

The thus-cold-drawn wire is subjected to finish annealing by the continuous electric heat treatment. It is preferable that the conditions for the finish annealing satisfy: $26x^{-0.6}+377 \leq y \leq 19x^{-0.6}+477$, in the range of $0.03 \leq x \leq 0.55$, when the numerical formula represented by the wire temperature y (° C.) and the annealing time period x (sec) are used as mentioned above.

The aluminum alloy conductor of the present invention that is prepared by the heat treatment as mentioned above has a recrystallized microstructure. Herein, the recrystallized microstructure refers to a state of a microstructure that is constituted by grains that have little lattice defects, such as dislocation, introduced by plastic working. Since the conductor has a recrystallized microstructure, the tensile elongation at breakage and electrical conductivity are recovered, and a sufficient flexibility can be obtained.

EXAMPLES

The present invention will be described in more detail based on examples given below, but the invention is not meant to be limited by these.

Examples 1 to 27 and Comparative Examples 1 to 18

As shown in the following Table 1-1 and Table 2-1, each alloy was obtained with Fe, Mg, Si, Cu, Ti, V, and Al, or alternatively Fe, Mg, Si, Cu, Ti, V, Zr, and Al, at the respective predetermined content ratio (mass %), and a molten metal of the alloy was rolled while the molten metal was continuously cast in a water-cooled casting mold, by using a Properzi-type continuous cast-rolling machine, to give a rod with diameter about 10 mm. At that time, the cooling speed in casting was 1 to 20° C./sec (in Comparative Examples, the cases of 0.2° C./sec or 50° C./sec were also included).

Then, peeling off of the surface was conducted to adjust the diameter to 9 to 9.5 mm, and the thus-peeled rod was subjected to wire drawing to the diameter of 2.6 mm. Then, as shown in Table 1-1 and Table 2-1, the thus-roughly-cold-drawn wire was subjected to intermediate annealing at a temperature of 300 to 450° C. (in Comparative Examples, the cases of 200° C. or 550° C. were also included) for 0.17 to 4 hours (in Comparative Examples, the case of 0.1 hour was also included), followed by wire drawing to a diameter of 0.31 mm in Examples 1 to 23 and Comparative Examples 1 to 18, to a diameter of 0.37 mm in Examples 24 and 25, and to a diameter of 0.43 mm in Examples 26 and 27.

Finally, a continuous electric heat treatment as the finish annealing was conducted at a temperature of 428 to 624° C. for a time period of 0.03 to 0.54 second. The temperature was measured at immediately above the water surface where the temperature of the wire would be the highest, with a fiber-type radiation thermometer (manufactured by Japan Sensor Corporation).

With respect to the wires thus prepared in Examples according to the present invention and Comparative Examples, the properties were measured according to the methods described below, and the results thereof are shown in the following Table 1-2 and Table 2-2.

(a) Grain Size (GS)

The transverse cross-section of the respective wire sample cut out vertically to the wire-drawing direction, was filled with a resin, followed by mechanical polishing and electrolytic polishing. The conditions of the electrolytic polishing were as follows: polish liquid, a 20% ethanol solution of perchloric acid; liquid temperature, 0 to 5° C.; voltage, 10 V; current, 10 mA; and time period, 30 to 60 seconds. Then, in order to obtain a contrast of grains, the resultant sample was subjected to anodizing finishing, with 2% hydrofluoroboric acid, under conditions of voltage 20 V, electrical current 20 mA, and time period 2 to 3 min. The resultant microstructure was observed by an optical microscope with a magnification of 200× to 400× and photographed, and the grain size was measured by an intersection method. Specifically, a straight line was drawn arbitrarily on a microscopic picture taken, and the number of intersection points at which the length of the straight line intersected with the grain boundaries was measured, to determine an average grain size. The grain size was evaluated by changing the length and the number of straight lines so that 50 to 100 grains would be counted.

(b) Sizes (Particle Sizes) and Area Ratios of Intermetallic Compounds

The wires of Examples and Comparative Examples were each formed into a thin film by an electropolishing thin-film method (twin-jet polishing), and an arbitrary region was observed with a magnification of 6,000× to 30,000×, by using a transmission electron microscope (TEM). Then, electron beam was focused on the intermetallic compounds by using an energy-dispersive X-ray detector (EDX), thereby to detect intermetallic compounds of an Al—Fe-based, an Al—Fe—Si-based, an Al—Zr-based, and the like.

The sizes of the intermetallic compounds were each judged from the scale of the picture taken, which were calculated by converting the shape of the individual particle to the sphere which was equal to the volume of the individual particle. The area ratios a, b, and c of the intermetallic compounds were obtained, based on the picture taken, by setting a region in which about 5 to 10 particles would be counted for the intermetallic compound A, a region in which 20 to 50 particles would be counted for the intermetallic compound B, and a region in which 50 to 100 particles would be counted for the intermetallic compound C, calculating the areas of the intermetallic compounds from the sizes and the numbers of respective intermetallic compounds, and dividing the areas of the respective intermetallic compounds by the areas of the regions for the counting.

The area ratios were each calculated, by using a reference thickness of 0.15 μm for the thickness of a slice of the respective sample. In the case where the sample thickness was different from the reference thickness, the area ratio was able to be calculated, by converting the sample thickness to the reference thickness, i.e. by multiplying the area ratio calculated based on the picture taken by (reference thickness/sample thickness). In the Examples and Comparative Examples, the sample thickness was calculated by observing the interval of equal thickness fringes observed on the picture, and was approximately 0.15 μm in all of the samples.

(c) Tensile Strength (TS) and Tensile Elongation at Breakage

Three test pieces for each sample were tested according to JIS Z 2241, and the average value was obtained, respectively.

(d) Electrical Conductivity (EC)

Specific resistivity of three test pieces with length 300 mm for each sample was measured, by using a four-terminal method, in a thermostatic bath kept at 20° C. (±0.5° C.), to calculate the average electrical conductivity therefrom. The distance between the terminals was set to 200 mm.

(e) The Number of Repeating Times at Breakage

As a criterion for the resistance to bending fatigue, a strain amplitude at an ordinary temperature was set to ±0.17%. The resistance to bending fatigue varies depending on the strain amplitude. When the strain amplitude is large, the resultant fatigue life is short, while when small, the resultant fatigue life is long. Since the strain amplitude can be determined by the wire diameter of a wire 1 and the curvature radii of bending jigs 2 and 3 as shown in FIG. 1, a bending fatigue test can be conducted by arbitrarily setting the wire diameter of the wire 1 and the curvature radii of the bending jigs 2 and 3.

Using a reversed bending fatigue test machine manufactured by Fujii Seiki, Co. Ltd. (currently renamed to Fujii, Co. Ltd.), and using jigs that can impart a bending strain of ±0.17% to the wire, the number of repeating times at breakage was measured, by conducting repeated bending. The number of repeating times at breakage was measured from 4 test pieces for each sample, and the average value thereof was obtained. As shown in the explanatory view of FIG. 1, the wire 1 was inserted between the bending jigs 2 and 3 that were spaced by 1 mm, and moved in a reciprocate manner along the jigs 2 and 3. One end of the wire was fixed on a holding jig 5 so that bending can be conducted repeatedly, and a weight 4 of about 10 g was hanged from the other end. Since the holding jig 5 moves in the test, the wire 1 fixed thereon also moves, thereby repeating bending can be conducted. The repeating was conducted under the condition of 1.5 Hz (1.5 times of reciprocation in 1 second), and the test machine has a mechanism in which the weight 4 falls to stop counting when the test piece of the wire 1 is broken.

Assuming the use for 20 years with 10 times of opening and closing in a day, the number of openings and closings is 73,000 (calculated by regarding 1 year to be 365 days). Since an electrical wire which is actually used is not a single wire but in a twisted wire structure, and is subjected to a coating treatment, the load on the electrical wire conductor becomes as less as one severalth. The number of repeating times at breakage is preferably 80,000 or more, more preferably 100,000 or more, by which sufficient resistance to bending fatigue can be ensured as an evaluation value in a single wire.

(f) Workability

Figure 2:
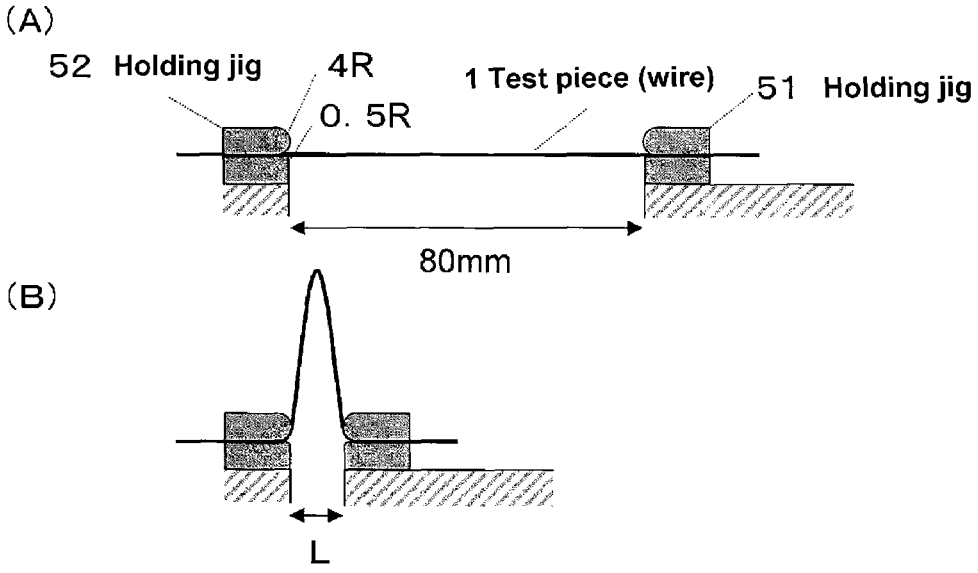
{FIG. 2}

As shown in the explanatory view of FIG. 2 (A), each end of the drawn wire 1 was fixed on the holding jig 51 or 52, respectively, so that the wire would have a length of 80 mm, and then a free bending test was conducted, in which one end 51 was slid and bent to put close to another end up to a given length L, as shown in FIG. 2 (B), and the wire was then returned to the state shown in FIG. 2 (A), followed by conducting those movements repeatedly. The cycle (A)→(B)→(A) in FIG. 2 was regarded as one time of repeating. In the figures, 4R and 0.5R represent corner portions with curvature radii 4 and 0.5 mm, respectively. The number of repeating times varies depending on a stress applied. When the stress applied is high, the number of repeating times is small, while when the stress applied is low, the number of repeating times is high. The stress applied can be determined by the wire diameter of the wire 1 shown in FIG. 2 and the distance L between the holding jigs 51 and 52 when put close each other [FIG. 2 (B)]. Accordingly, the test was conducted, by setting L=10.0 mm at wire diameter 0.31 mm, L=11.9 mm at wire diameter 0.37 mm, and L=13.9 mm at wire diameter 0.43 mm, so that a same level of stress would be applied. With respect to the number of repeating times until broken, the average value was measured by testing three test pieces for each sample. When the average value was 3 or more, the sample was judged to be "Good" and indicated by "o" in the table, and when the average value was less than 3, the sample was judged to be "Poor" and indicated by "x" in the table.

TABLE 1-1

(Examples)

| No. | Fe | Mg | Si | Cu | Ti + V | Zr | Al | Cooling speed in casting ° C./s | Intermediate annealing Temp. ° C. | Intermediate annealing Time h | Finish annealing Temp. ° C. | Finish annealing Time s | $26x^{-0.6} + 377$ | $19x^{-0.6} + 477$ |
|---|---|---|---|---|---|---|---|---|---|---|---|---|---|---|
| | mass % | | | | | | | | | | | | | |
| 1 | 0.04 | 0.12 | 0.08 | 0.20 | 0.002 | 0.00 | bal. | 5 | 450 | 0.5 | 465 | 0.54 | 415 | 504 |
| 2 | 0.06 | 0.13 | 0.26 | 0.49 | 0.005 | 0.00 | | 1 | 400 | 1 | 428 | 0.54 | 415 | 504 |
| 3 | 0.03 | 0.21 | 0.10 | 0.19 | 0.009 | 0.00 | | 1 | 400 | 2 | 518 | 0.11 | 476 | 549 |
| 4 | 0.03 | 0.25 | 0.20 | 0.20 | 0.004 | 0.00 | | 5 | 350 | 2 | 535 | 0.11 | 476 | 549 |
| 5 | 0.05 | 0.26 | 0.27 | 0.11 | 0.003 | 0.00 | | 20 | 400 | 0.5 | 534 | 0.11 | 476 | 549 |
| 6 | 0.12 | 0.11 | 0.07 | 0.19 | 0.003 | 0.00 | | 1 | 300 | 2 | 464 | 0.54 | 415 | 504 |
| 7 | 0.12 | 0.11 | 0.29 | 0.20 | 0.002 | 0.00 | | 5 | 400 | 0.17 | 491 | 0.54 | 415 | 504 |
| 8 | 0.11 | 0.19 | 0.18 | 0.48 | 0.004 | 0.00 | | 10 | 350 | 0.17 | 485 | 0.18 | 450 | 530 |
| 9 | 0.15 | 0.26 | 0.22 | 0.20 | 0.006 | 0.00 | | 15 | 450 | 1 | 511 | 0.11 | 476 | 549 |
| 10 | 0.14 | 0.29 | 0.19 | 0.31 | 0.010 | 0.00 | | 20 | 300 | 2 | 620 | 0.03 | 590 | 633 |
| 11 | 0.20 | 0.11 | 0.11 | 0.11 | 0.003 | 0.00 | | 1 | 350 | 4 | 597 | 0.03 | 590 | 633 |
| 12 | 0.22 | 0.12 | 0.23 | 0.38 | 0.004 | 0.00 | | 5 | 450 | 3 | 457 | 0.54 | 415 | 504 |
| 13 | 0.23 | 0.24 | 0.06 | 0.21 | 0.003 | 0.00 | | 10 | 450 | 2 | 488 | 0.18 | 450 | 530 |
| 14 | 0.22 | 0.27 | 0.26 | 0.40 | 0.003 | 0.00 | | 15 | 300 | 0.17 | 513 | 0.11 | 476 | 549 |
| 15 | 0.22 | 0.28 | 0.28 | 0.19 | 0.006 | 0.00 | | 20 | 400 | 4 | 612 | 0.03 | 590 | 633 |
| 16 | 0.35 | 0.10 | 0.10 | 0.11 | 0.008 | 0.00 | | 10 | 450 | 0.5 | 610 | 0.03 | 590 | 633 |
| 17 | 0.32 | 0.10 | 0.25 | 0.31 | 0.004 | 0.00 | | 15 | 350 | 1 | 624 | 0.03 | 590 | 633 |
| 18 | 0.32 | 0.25 | 0.28 | 0.38 | 0.002 | 0.00 | | 15 | 350 | 2 | 510 | 0.11 | 476 | 549 |
| 19 | 0.40 | 0.28 | 0.08 | 0.11 | 0.003 | 0.00 | | 10 | 450 | 3 | 488 | 0.11 | 476 | 549 |
| 20 | 0.38 | 0.26 | 0.25 | 0.20 | 0.003 | 0.00 | | 20 | 450 | 0.5 | 490 | 0.11 | 476 | 549 |
| 21 | 0.22 | 0.21 | 0.20 | 0.38 | 0.004 | 0.12 | | 5 | 350 | 4 | 515 | 0.11 | 476 | 549 |
| 22 | 0.22 | 0.15 | 0.18 | 0.31 | 0.006 | 0.23 | | 10 | 400 | 2 | 492 | 0.11 | 476 | 549 |
| 23 | 0.23 | 0.27 | 0.17 | 0.31 | 0.003 | 0.35 | | 15 | 450 | 2 | 535 | 0.11 | 476 | 549 |
| 24 | 0.22 | 0.12 | 0.20 | 0.46 | 0.003 | 0.00 | | 5 | 400 | 1 | 612 | 0.03 | 590 | 633 |
| 25 | 0.25 | 0.25 | 0.21 | 0.13 | 0.004 | 0.00 | | 10 | 400 | 1 | 598 | 0.03 | 590 | 633 |
| 26 | 0.15 | 0.11 | 0.15 | 0.20 | 0.005 | 0.00 | | 15 | 300 | 1 | 510 | 0.11 | 476 | 549 |
| 27 | 0.20 | 0.28 | 0.13 | 0.33 | 0.004 | 0.00 | | 15 | 350 | 1 | 505 | 0.11 | 476 | 549 |

TABLE 1-2

(Examples)

| No. | Area ratio (%) a | Area ratio (%) b | Area ratio (%) c | GS μm | TS MPa | EC % IACS | The number of repeating times at breakage $\times 10^3$ | Workability | Tensile elongation at breakage % |
|---|---|---|---|---|---|---|---|---|---|
| 1 | 0.19 | 0.27 | 2.4 | 23 | 104 | 61.0 | 95 | ○ | 22.0 |
| 2 | 0.34 | 0.42 | 4.6 | 20 | 131 | 56.6 | 127 | ○ | 16.4 |
| 3 | 0.15 | 0.23 | 3.0 | 22 | 106 | 59.0 | 96 | ○ | 20.0 |
| 4 | 0.13 | 0.25 | 4.4 | 25 | 111 | 58.1 | 103 | ○ | 17.4 |
| 5 | 0.18 | 0.35 | 5.7 | 25 | 108 | 57.8 | 103 | ○ | 17.6 |
| 6 | 0.72 | 0.94 | 2.2 | 14 | 112 | 61.0 | 96 | ○ | 27.0 |
| 7 | 0.66 | 0.78 | 2.5 | 16 | 119 | 58.2 | 98 | ○ | 16.7 |
| 8 | 0.54 | 0.79 | 5.1 | 13 | 137 | 57.1 | 130 | ○ | 16.8 |
| 9 | 0.68 | 0.87 | 6.1 | 13 | 123 | 57.3 | 114 | ○ | 17.7 |
| 10 | 0.56 | 1.08 | 5.3 | 14 | 130 | 56.3 | 120 | ○ | 17.7 |
| 11 | 1.23 | 1.40 | 4.0 | 11 | 111 | 60.8 | 101 | ○ | 25.3 |
| 12 | 1.24 | 1.26 | 3.5 | 10 | 135 | 57.4 | 118 | ○ | 17.7 |
| 13 | 1.18 | 1.32 | 1.9 | 9.3 | 122 | 59.6 | 99 | ○ | 19.6 |
| 14 | 1.01 | 1.67 | 7.2 | 11 | 142 | 55.9 | 138 | ○ | 16.8 |
| 15 | 0.90 | 1.40 | 7.7 | 9.1 | 128 | 56.3 | 123 | ○ | 17.3 |
| 16 | 1.82 | 1.98 | 3.0 | 6.0 | 118 | 60.0 | 99 | ○ | 27.3 |
| 17 | 1.49 | 2.21 | 2.3 | 8.6 | 135 | 57.5 | 112 | ○ | 18.2 |
| 18 | 1.49 | 2.01 | 6.9 | 7.3 | 146 | 55.8 | 137 | ○ | 17.0 |
| 19 | 2.08 | 2.26 | 3.0 | 1.6 | 126 | 59.3 | 101 | ○ | 21.3 |
| 20 | 1.58 | 2.15 | 8.4 | 3.2 | 135 | 56.8 | 131 | ○ | 16.1 |
| 21 | 1.24 | 3.39 | 5.6 | 10 | 137 | 56.7 | 111 | ○ | 16.7 |
| 22 | 1.13 | 3.67 | 5.2 | 6.8 | 130 | 57.2 | 105 | ○ | 17.6 |
| 23 | 1.06 | 3.93 | 3.8 | 7.5 | 133 | 56.4 | 98 | ○ | 16.3 |
| 24 | 1.24 | 1.40 | 3.5 | 11 | 140 | 57.4 | 125 | ○ | 16.8 |
| 25 | 1.29 | 1.58 | 7.1 | 9.2 | 122 | 57.9 | 117 | ○ | 18.9 |
| 26 | 0.76 | 1.16 | 3.2 | 14 | 116 | 59.5 | 103 | ○ | 21.7 |
| 27 | 0.92 | 1.40 | 3.8 | 12 | 132 | 57.6 | 116 | ○ | 17.5 |

TABLE 2-1

(Comparative Examples)

| No. | Fe | Mg | Si | Cu | Ti + V | Zr | Al | Cooling speed in casting ° C./s | Intermediate annealing Temp. ° C. | Intermediate annealing Time h | Finish annealing Temp. ° C. | Finish annealing Time s | $26x^{-0.6}+377$ | $19x^{-0.6}+477$ |
|---|---|---|---|---|---|---|---|---|---|---|---|---|---|---|
| | mass % | | | | | | | | | | | | | |
| 1 | 0.60 | 0.21 | 0.20 | 0.21 | 0.002 | 0.00 | bal. | 5 | 400 | 1 | 508 | 0.03 | 500 | 633 |
| 2 | 0.19 | 0.05 | 0.20 | 0.19 | 0.003 | 0.00 | | 10 | 350 | 1 | 605 | 0.03 | 590 | 633 |
| 3 | 0.20 | 0.40 | 0.19 | 0.20 | 0.003 | 0.00 | | 10 | 350 | 1 | 453 | 0.54 | 415 | 504 |
| 4 | 0.22 | 0.20 | 0.01 | 0.19 | 0.006 | 0.00 | | 10 | 450 | 1 | 451 | 0.54 | 415 | 504 |
| 5 | 0.20 | 0.20 | 0.41 | 0.19 | 0.003 | 0.00 | | 10 | 450 | 2 | 511 | 0.11 | 476 | 549 |
| 6 | 0.21 | 0.19 | 0.21 | 0.04 | 0.005 | 0.00 | | 5 | 300 | 2 | 510 | 0.11 | 476 | 549 |
| 7 | 0.19 | 0.21 | 0.18 | 0.70 | 0.003 | 0.00 | | 5 | 350 | 2 | 491 | 0.11 | 476 | 549 |
| 8 | 0.18 | 0.19 | 0.20 | 0.20 | 0.030 | 0.00 | | 15 | 350 | 2 | 485 | 0.11 | 476 | 549 |
| 9 | 0.20 | 0.21 | 0.20 | 0.20 | 0.004 | 0.55 | | 15 | 400 | 2 | 486 | 0.11 | 476 | 549 |
| 10 | 0.19 | 0.21 | 0.18 | 0.20 | 0.002 | 0.00 | | 0.2 | 300 | 0.5 | 509 | 0.11 | 476 | 549 |
| 11 | 0.19 | 0.20 | 0.21 | 0.21 | 0.006 | 0.00 | | 50 | 450 | 0.5 | 510 | 0.11 | 476 | 549 |
| 12 | 0.20 | 0.21 | 0.21 | 0.20 | 0.004 | 0.00 | | 1 | 200 | 0.5 | — | | | |
| 13 | 0.19 | 0.20 | 0.20 | 0.21 | 0.002 | 0.00 | | 1 | 550 | 0.5 | — | | | |
| 14 | 0.20 | 0.21 | 0.21 | 0.19 | 0.004 | 0.00 | | 1 | 400 | 0.1 | — | | | |
| 15 | 0.23 | 0.19 | 0.21 | 0.21 | 0.003 | 0.00 | | 20 | 300 | 1 | 453 | 0.11 | 476 | 549 |
| 16 | 0.20 | 0.21 | 0.20 | 0.19 | 0.004 | 0.00 | | 20 | 450 | 1 | 570 | 0.11 | 476 | 549 |
| 17 | 0.20 | 0.21 | 0.20 | 0.21 | 0.003 | 0.00 | | 5 | 400 | 2 | Finish annealing (batch annealing furnace) 400° C., 2 hr | | | |
| 18 | 0.20 | 0.20 | 0.19 | 0.19 | 0.003 | 0.00 | | 15 | 400 | 2 | Finish annealing (batch annealing furnace) 450° C., 2 hr | | | |

TABLE 2-2

(Comparative Examples)

| No. | Area ratio (%) a | Area ratio (%) b | Area ratio (%) c | GS μm | TS MPa | EC % IACS | The number of repeating times at breakage $\times 10^3$ | Workability | Tensile elongation at breakage % |
|---|---|---|---|---|---|---|---|---|---|
| 1 | 3.78 | 3.73 | 6.8 | 3.2 | 144 | 57.5 | 72 | x | 8.9 |
| 2 | 0.97 | 1.33 | 0.3 | 14 | 89 | 59.6 | 58 | ○ | 22.7 |
| 3 | 1.02 | 1.40 | 13.0 | 10 | 129 | 56.8 | 72 | x | 12.7 |
| 4 | 1.13 | 1.26 | 0.0 | 13 | 83 | 60.3 | 60 | ○ | 25.0 |
| 5 | 1.02 | 4.11 | 5.6 | 14 | 129 | 55.9 | 64 | x | 15.5 |
| 6 | 1.18 | 1.60 | 5.3 | 15 | 94 | 58.9 | 62 | ○ | 22.7 |
| 7 | 1.07 | 4.33 | 6.2 | 13 | 145 | 54.2 | 83 | x | 14.2 |
| 8 | 0.82 | 1.27 | 6.8 | 5.5 | 125 | 53.8 | 65 | x | 13.9 |
| 9 | 0.92 | 6.44 | 6.8 | 10 | 139 | 55.7 | 54 | x | 11.4 |
| 10 | 4.90 | 1.45 | 5.1 | 14 | 122 | 58.4 | 54 | x | 9.1 |
| 11 | 0.10 | 4.78 | 5.6 | 15 | 124 | 52.1 | 69 | x | 13.1 |
| 12 | Wire breakage | | | | | | | — | Wire breakage |
| 13 | Wire breakage | | | | | | | — | Wire breakage |
| 14 | Wire breakage | | | | | | | — | Wire breakage |
| 15 | Not observed due to unannealed state* | | | | 156 | 57.0 | 145 | x | 2.1 |
| 16 | 0.82 | 1.15 | 0.0 | 18 | 62 | 58.1 | 35 | x | 4.8 |
| 17 | 1.12 | 1.28 | 0.1 | 12.6 | 126 | 58.2 | 72 | ○ | 16.1 |
| 18 | 0.92 | 1.30 | 0.0 | 15.0 | 123 | 58.5 | 65 | ○ | 17.2 |

Note:

*It was impossible to observe those, due to the un-annealed state of the microstructure.

The followings can be understood, from the results in Table 1-1, Table 1-2, Table 2-1, and Table 2-2.

In Comparative Examples 1 to 9, the alloying elements added to the aluminum alloy were outside of the ranges according to the present invention. In Comparative Example 1, since the content of Fe was too large, the ratios of the intermetallic compounds A and B were too large, and the workability, the number of repeating times at breakage, and the tensile elongation at breakage were poor. In Comparative Example 2, since the content of Mg was too low, the ratio of the intermetallic compound C was too low, and the tensile strength and the number of repeating times at breakage were poor. In Comparative Example 3, since the content of Mg was too large, the ratio of the intermetallic compound C was too large, and the workability and the number of repeating times at breakage were poor. In Comparative Example 4, since the content of Si was too low, the ratio of the intermetallic compound C was too low, and the tensile strength and the number of repeating times at breakage were poor. In Comparative Example 5, since the content of Si was too large, the ratio of the intermetallic compound B was too large, and the workability and the number of repeating times at breakage were poor. In Comparative Example 6, since the content of Cu was too low, the tensile strength and the number of repeating times at breakage were poor. In Comparative Example 7, since the content of Cu was too large, the ratio of the intermetallic compound B was too large, and the workability and the electrical conductivity were poor. In Comparative Example 8, since the total content of Ti and V was too large, the workability, the number of repeating times at breakage, and the electrical conductivity were poor. In Comparative Example 9, since the content of Zr was too large, the ratio of the intermetallic compound B was too large, and the workability and the number of repeating times at breakage were poor.

Comparative Examples 10 to 18 show the cases where the area ratios of the intermetallic compounds in the respective aluminum alloy conductor were outside of the ranges according to the present invention, or the cases where the conductors were broken in the course of production. Those Comparative Examples show that no aluminum alloy conductor as defined in the present invention was able to be obtained, depending on the conditions for the production of the aluminum alloy. In Comparative Example 10, since the cooling speed in casting was too slow and the ratio of the intermetallic compound A was too large, the workability, the number of repeating times at breakage, and the tensile elongation at breakage were poor. In Comparative Example 11, since the ratio of the intermetallic compound B was too large, the workability and the number of repeating times at breakage were poor, and since the cooling speed in casting was too fast, the electrical conductivity was poor. In all of Comparative Examples 12 to 14, since no finish annealing was conducted, the target conductor wires were broken in the wire drawing step. In Comparative Example 15, since the resultant alloy was in an unannealed state due to insufficient softening in the finish-annealing step and no intermetallic compound was observed, the workability and the tensile elongation at breakage were poor. In Comparative Example 16, since the ratio of the intermetallic compound C was too low due to a too high temperature for the finish annealing, the workability, the tensile strength, the number of repeating times at breakage, and the tensile elongation at breakage were poor. In Comparative Examples 17 and 18, since the ratio of the intermetallic compound C was too low as the result of the batch annealing used as the finish annealing, the number of repeating times at breakage was poor.

Contrary to the above, in Examples 1 to 27 according to the present invention, the aluminum alloy conductors were able to be obtained, which were favorable in workability, and excellent in the number of repeating times at breakage (the resistance to bending fatigue), the tensile elongation at breakage (the flexibility), the tensile strength, and the electrical conductivity.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2010-043487 filed in Japan on Feb. 26, 2010, which is entirely herein incorporated by reference.

REFERENCE SIGNS LIST

1 Test piece (wire)
2, 3 Bending jig
4 Weight
5, 51, 52 Holding jig

The invention claimed is:

1. An aluminum alloy conductor, consisting essentially of: 0.01to 0.4 mass % of Fe, 0.1 to 0.3 mass % of Mg, 0.04 to 0.3 mass % of Si, and 0.1 to 0.5 mass % of Cu, and 0.001 to 0.01 mass % of Ti and V in total, with the balance being Al and inevitable impurities, wherein the conductor contains three kinds of intermetallic compounds A, B, and C, in which the intermetallic compound A has a particle size within the range of 0.1 μm or more but 2 μm or less and is selected from the group consisting of Al—Fe, Al—Fe—Si, Al—Fe—Si—Cu, and Al—Zr, the intermetallic compound B has a particle size within the range of 0.03 μm or more but less than 0.1 μm and is selected from the group consisting of Al—Fe—Si, Al—Fe—Si—Cu, and Al—Zr, the intermetallic compound C has a particle size within the range of 0.001 μm or more but less than 0.03 μm, and an area ratio a of the intermetallic compound A, an area ratio b of the intermetallic compound B, and an area ratio c of the intermetallic compound C, in an arbitrary region in the conductor, satisfy the relationships of 0.1%≤a ≤2.5%, 0.1% ≤b ≤3%, and 1%≤c≤10%, respectively, wherein the aluminum alloy conductor has a recrystallized microstructure.

2. The aluminum alloy conductor according to claim 1, which has a grain size at a vertical cross-section in the wire-drawing direction of 1 to 30 μm, by subjecting to a continuous electric heat treatment, which comprises the steps of rapid heating and quenching at the end of the production process of the conductor.

3. The aluminum alloy conductor according to claim 1, which has a tensile strength of 100 MPa or more, and an electrical conductivity of 55% IACS or more.

4. The aluminum alloy conductor according to claim 1, which has a tensile elongation at breakage of 10% or more.

5. An aluminum alloy conductor, consisting essentially of: 0.01 to 0.4 mass % of Fe, 0.1 to 0.3 mass % of Mg, 0.04 to 0.3 mass % of Si, 0.1 to 0.5 mass % of Cu, and 0.01 to 0.4 mass % of Zr, and 0.001 to 0.01 mass % of Ti and V in total, with the balance being Al and inevitable impurities, wherein the conductor contains three kinds of intermetallic compounds A, B, and C, in which the intermetallic compound A has a particle size within the range of 0.1 μor more but 2 μm or less and is selected from the group consisting of Al—Fe, Al—Fe—Si, Al—Fe—Si—Cu, and Al—Zr, the intermetallic compound B has a particle size within the range of 0.03 μm or more but less than 0.1 μm and is selected from the group consisting of Al—Fe—Si, Al—Fe—Si—Cu, and Al—Zr, the intermetallic compound C has a particle size within the range of 0.001 μm or more but less than 0.03 μm, and an area ratio a of the intermetallic compound A, an area ratio b of the intermetallic compound B, and an area ratio c of the intermetallic compound C, in an arbitrary region in the conductor, satisfy the relationships of 0.1%≤a≤2.5%, 0.1%≤b≤5.5%, and 1%≤c≤10%, respectively, wherein the aluminum alloy conductor has a recrystallized microstructure.

6. The aluminum alloy conductor according to claim 5, which has a grain size at a vertical cross-section in the wire-drawing direction of 1 to 30 μm, by subjecting to a continuous electric heat treatment, which comprises the steps of rapid heating and quenching at the end of the production process of the conductor.

7. The aluminum alloy conductor according to claim 5, which has a tensile strength of 100 MPa or more, and an electrical conductivity of 55% IACS or more.

8. The aluminum alloy conductor according to claim 5, which has a tensile elongation at breakage of 10% or more.

* * * * *